United States Patent [19]

Weisman et al.

[11] Patent Number: 4,944,120

[45] Date of Patent: Jul. 31, 1990

[54] DOP FOR GEMSTONE HANDLING DURING MANUFACTURE

[76] Inventors: Ilan Weisman, 52 Brener Street, Herzelia; Roni Shapira, Moshav Givat-Chen, Ranana; Roni Shafir, 9 Leon Blum Street, Ramat-Aviv; Hanoh Shtark, 23 Lamerchav Street, Ramat Hasaron, all of Israel

[21] Appl. No.: 366,928

[22] Filed: Jun. 16, 1989

[30] Foreign Application Priority Data

Jun. 16, 1988 [IL] Israel ..... 86761

[51] Int. Cl.[5] ..... B24B 49/00

[52] U.S. Cl. ..... 51/165.72; 51/229

[58] Field of Search ..... 51/165.71, 229; 81/DIG. 5

[56] References Cited

U.S. PATENT DOCUMENTS 1,618,715 2/1927 Lammers et al. ..... 81/DIG. 5

*Primary Examiner*—Robert Rose

*Assistant Examiner*—M. Rachuba

[57] ABSTRACT

A dop for handling a gemstone comprising an elongate shaft having shank and gripper portions located at respective ends thereof, a shaped portion about the shaft defining a plurality of externally sensible features for providing information uniquely identifying the dop and establishing its spatial orientation and that of the gemstone.

40 Claims, 1 Drawing Sheet

DOP FOR GEMSTONE HANDLING DURING MANUFACTURE

FIELD OF THE INVENTION

The present invention relates to machinery and devices used in the diamond and gemstone manufacturing process, and more particularly, to a novel structure for a dop useful in handling such stones during manufacturing, polishing and finishing operations.

BACKGROUND OF THE INVENTION

There are known constructions for the dop used to hold a gemstone during various production operations. These typically include a ring or pot formed on the end of an elongate shaft which is rotatable about its axis. Once the gemstone is mounted on the dop, it may be more easily examined and decisions taken as to the required manufacturing procedures in cutting, grinding, polishing or other finishing operations. Identification of the dop-mounted gemstone and the associated finishing procedures to be used in these operations then becomes important, since each gemstone must be treated individually. Where gemstones are transferred between production stations in non-sequential fashion, the result could be mishandling of individual gemstones and confusion as to the appropriate finishing procedures decided upon earlier.

In addition, for finishing procedures such as polishing, a machine operator must properly orient and secure the dop on the machine polishing arm. The orientation of the dop will determine the facet of the gemstone on which the polishing procedure will begin when it is placed against the grinding wheel. In order to correctly implement previous decisions regarding the correct polishing procedure and orientation of the gemstone, an orientation reference point is needed to maintain the necessary level of precision, so as to achieve the overall manufacturing objectives, especially where automatic machining is involved.

Since the manufacturing environment contains foreign matter such as dirt, dust, abrasives, etc., adequate precautions must be taken to insure that these materials do not interfere with identification and orientation of the gemstone.

Therefore, it would be desirable to provide a means of identifying the correct finishing procedures associated with particular gemstones in production operations, eliminating incorrect orientation and achieving more effective implementation of previous production-related decisions.

SUMMARY OF THE INVENTION

Accordingly, it is a principal object of the present invention to overcome the above-described gemstone identification and orientation difficulties and provide a dop for handling gemstones which can be identified by features of its shape and is useful in identifying the gemstone, its orientation and associated working procedures.

In accordance with the present invention, there is provided a dop for handling a gemstone comprising:

an elongate shaft having shank and gripper portions located at respective ends thereof, a shaped portion about the shaft defining a plurality of externally sensible features for providing information uniquely identifying the dop and establishing its spatial orientation and that of the gemstone.

In a preferred embodiment, the externally sensible features of the inventive dop are provided on the shaped portion by a series of circumferential rings having different radial and/or axial height dimensions. Using the different ring dimensions in combination, a dop identification code can be developed. The dop can be identified by an optical detection system which "reads" the code. After the code is interpreted, preferably by a computer, a predetermined set of handling procedures associated with a gemstone mounted in the identified dop can then be effected.

Because the rings are symmetrical about the dop axis, any surface dirt or other foreign matter that may become attached to the dop can be distinguished from the true surface of the rings by the optical detection system when the dop is rotated. Reading the code on several locations of the symmetrical ring insures that such materials will not interfere with the reading taken.

To establish the spatial orientation of the dop, at least one ring has a bore hole provided therethrough and to one side of the shaft axis. A light detector placed near one end of the bore hole senses the passage of light therethrough to determine the dop orientation once the gemstone has been affixed thereto by glue or otherwise. Use of the bore hole enables determination of the dop orientation with a precision of about 1/3000 part of a dop rotation.

If the gemstone is affixed with a predetermined orientation in relation to the bore hole, and the mechanical insertion of the dop into a given manufacturing machine is known, it is possible to establish the spatial orientation of the gemstone. From this information, a reference point in space can be established in a reference coordinate system to provide the appropriate location on the gemstone for beginning the grinding or polishing process, for example.

Once the dop has been identified and its orientation established, any of several handling procedures may be performed. These include adjustments to the dop orientation to compensate for a particular eccentricity of rotation about the shaft axis, or to establish the dop orientation for any of a series of multi-dimensional movements utilized in the manufacturing process. The gemstone can be processed through a plurality of manufacturing stations in non-sequential fashion, since unique identification of the dop also identifies the particular gemstone to which the associated handling procedures will be applied for any given station.

In one embodiment, a non-contact optical system is employed to "read" the combination of the ring dimensions using edge detection techniques. This may include the use of image processing techniques to determine the radial ring dimension about the shaft axis, or the ring axial height. This information may then be passed to the polishing machine, which decodes it to identify the dop. Once the reference point is established, the machine proceeds to implement stored instructions associated with that dop for polishing the gemstone accordingly.

In another embodiment, the radial and axial ring dimensions can be "read" by a series of feeler gauges or other mechanical means of sensing appropriately mounted in the vicinity of the dop. Again, the information may be used to automatically control the polishing machine.

Other sensible features of the improved dop are provided by the shoulders formed between individual rings. The axial dimension between each individual shoulder and the outermost edge of the gripper portion provides another source of codable information.

By use of the inventive dop, errors in the manufacturing process are minimized. Once the orientation and working procedure information for a given gemstone are decided upon and stored for use by various production machinery, the improved dop acts as a "tag" which identifies this information via the shaped portion. This means the information is provided as an integral part of the manufacturing operation and utilized more efficiently with less likelihood of error on the part of machine operators during polishing and finishing procedures.

In one embodiment, the shaped portion is machined as an integral part of the dop construction.

In an alternative embodiment, the individual circumferential rings comprising the shaped portion may each be placed on the shaft and fastened thereon.

Other alternative embodiments of the dop include variations in the design of the shaped portion such that it contains codable information.

Other features and advantages of the inventive dop will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF A PREFERRED EMBODIMENT

Figure 1:
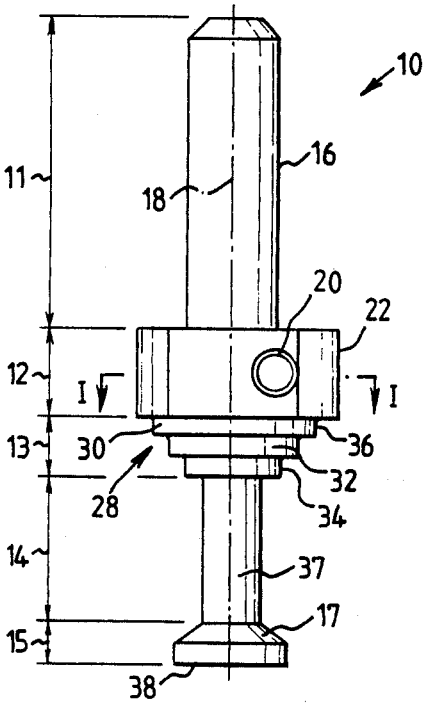
FIG. 1 is a front elevation view of an improved dop constructed and operated in accordance with the principles of the present invention.

Referring now to FIG. 1, there is shown a front elevation view of a preferred embodiment of a dop 10 for working gemstones, which is designed and constructed in accordance with the principles of the present invention. Dop 10 comprises an elongate shaft in which five principal sections can be identified, a dop mounting section 11, an orientation section 12, a coding section 13, an illumination section 14, and a stone mounting section 15. Each of these sections is now described.

Dop mounting section 11 comprises a cylindrical or otherwise-shaped shank 16 intended for fastening dop 10 in the chuck of a grinding or polishing machine, for example. Mounting section 15 comprises a gripper portion 17 which provides a mounting location for a gemstone (not shown) to be worked, which is mounted therein by glue or mechanical means. Shank 16 has an axis 18 about which it is rotated during orientation and identification procedures as further described herein.

Figure 2:
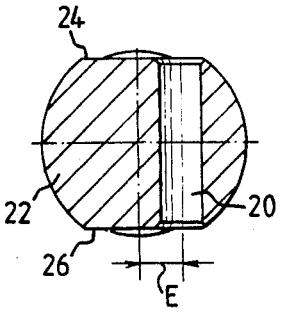
FIG. 2 is a sectional plan view taken along the section line I—I of FIG. 1.

In a midsection of shank 16, orientation section 12 comprises a bore hole 20 located to one side of axis 18, through a truncated ring 22. In FIG. 2, a sectional plan view of truncated ring 22 is shown taken along section line I—I of FIG. 1. Here, bore hole 20 can be seen as extending directly through truncated ring 22, terminating on truncated edges 24 and 26, which are generally flat. The center of bore hole 20 is spaced apart from the center of truncated ring 22 by an offset distance E. Alternatively, ring 22 may be circumferentially round.

Figure 3:
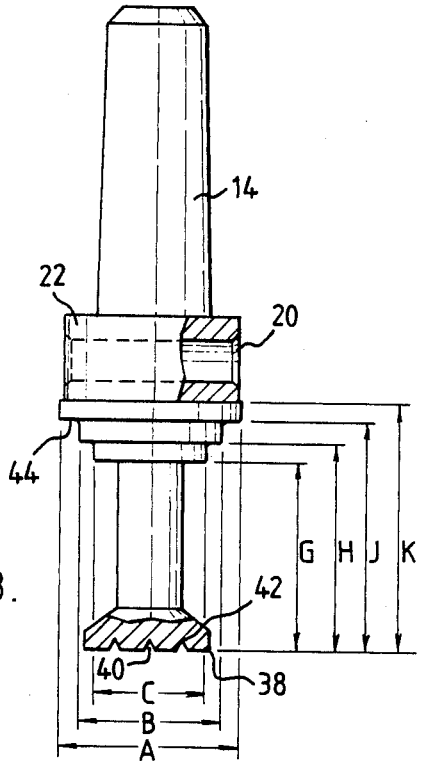
FIG. 3 is side elevation view of the improved dop of FIG. 1 showing partial cutaway views of portions of the construction.

Coding section 13 comprises a shaped portion 28, which may be integrally formed with dop 10 when constructed as a machined part. Shaped portion 28 comprises a series of circumferential rings, which include a series of rings 30, 32 and 34 having diameters corresponding respectively to dimensions shown as A, B, and C (FIG. 3). As shown, rings 30–34 provide a set of stepped outer edges such as edge 36 associated with ring 30.

As an alternative to forming dop 10 with shaped portion 28 as an integrally machined part, rings 30–34 can be provided individually for mounting and fastening on shaft 12.

Illumination section 14 comprises a shaft extension 37 which is relatively narrower than shank 16, allowing for the approach of illumination sources directed at the gemstone from above gripper 17. This enables illumination to be provided substantially parallel to axis 18, as part of one or more techniques associated with gemstone working procedures.

In accordance with the principles of the present invention, dop 10 is constructed such that it can be uniquely identified together with the orientation and working procedures associated therewith. This information is used in the manufacturing process associated with the gemstone which is mounted therein. Identification of dop 10 is achieved by the use of shaped portion 28 to provide externally sensible features which can be "read" by a known optical or other detection system.

For example, the optical detection system (not shown) can be used to determine the initial orientation of the inventive dop 10 in order to establish the starting location for working the gemstone. This is accomplished by defining the initial orientation of dop 10 with respect to bore hole 20. The orientation of the gemstone mounted in gripper 17 can also be defined with respect to bore hole 20.

To achieve the initial orientation, light is then directed along a path intersecting truncated ring 22 to one side of axis 18. This light is detected on the other side of dop 10 when it passes through bore hole 20. As the dop rotates, the point of maximum light detection is determined, thereby establishing the initial orientation of dop 10 with a precision of about 1/3000 part of dop 10 rotation. Truncated edges 24 and 26 are preferably flat and minimize stray reflections, although this is not essential to the method, as ring 22 may be provided with rounded edges.

The top of the gemstone can be located by virtue of the distance from the machine in which it is mounted, and this is fixed by limited insertion of shank 16 into the chuck of the machine. Since the vertical dimension of the dop is known to its outermost edge 38, the spatial orientation of the gemstone is completely determined in a reference coordinate system and a reference point is established upon which all later gemstone manufacturing operations are based.

Once the initial orientation is known, the particular dop and gemstone mounted thereon must be identified. For this purpose, the optical detection system may also incorporate the use of image processing and edge detection techniques to sense the series of stepped outer edges 36 of rings 30–34 and determine the associated dimensions. The information derived from the combination of dimensions A–C can be interpreted, preferably by a computer, as a code uniquely identifying dop 10.

It is particular feature of the present invention that coding section is designed to be symmetrical with regard to rotation about axis 18 of shank 16. Since the gemstone manufacturing environment may contain dirt, dust or other foreign material which may become attached to the edges 36 of rings 30–34, it is important to avoid interference of these materials in the identification procedure. In accordance with the invention, symmetry of coding section 13 enables these materials to be distinguished from the true surface of rings 30–34 by rotation of dop 10 to read the code on several locations of the symmetrical rings, so that the optical detection system can ignore stray effects in identifying dop 10.

Identification of dop 10 then allows determination of the series of working procedures to be carried out on the gemstone. This is achieved by access to a look-up table containing a set of commands stored in a computer for control of the polishing machine operation, for example. In this way, a particular set of steps in a working procedure can be carried out in accordance with a previously established finishing design for a given gemstone. Thus, by virtue of rings 30–34, dop 10 can effectively be coded for identification and ultimately associated with predetermined gemstone working procedure information useful in the manufacturing process.

Referring now to FIG. 3, there is shown a side elevation view of improved dop 10, revealing partial cutaway views of truncated ring 22 and gripper portion 17. As shown, gripper portion 17 contains grooves 40 allowing for glue to flow and contact the inserted gemstone in area 42 for insuring a firm grip. Each of the dimensions G, H, J and K is an axial height dimension giving the distance between outermost edge 38 of gripper portion 17 and each of a series of shoulders such as shoulder 44 formed on respective ones of rings 30–34.

According to one embodiment, the individual axial height of each shoulder 44 may be directly measured by the optical detection system independent of edge 38. In this case, the height of individual shoulders 44 may be used to provide a code for dop 10, based on the differences between the G–K dimensions. Thus, the heights of shoulders 44 can be substituted for the A–C dimensions in providing information to identify the dop and retrieve stored instructions about the working procedure to be used in finishing a particular gemstone.

Alternatively, by appropriate adjustment of the optical detection system, coding of dop 10 can be based on a particular combination of G–K dimensions.

In use as part of a manufacturing process, dop 10 is selected for its unique identification as provided by the code of radial and/or axial height dimensions of shaped portion 28. Once the gemstone is glued or otherwise affixed to the gripper portion 17 of inventive dop 10, the shank 16 thereof may be placed in the chuck of a machine used to orient the gemstone at an examination station. Working procedures for use in a polishing station can be determined and associated with the dop identification code. Thus, when the gemstone reaches the polishing or other station and dop 10 is uniquely identified, the polishing or other manufacturing procedure associated with that gemstone can be easily effected.

In summary, dop 10 of the present invention provides increased accuracy and reduces errors in the manufacturing process by acting as a "tag" which allows identification based on the information coded in its shaped portion. Once the dop has been identified, it can be associated with gemstone handling or manufacturing instructions. Provision of this information as an integral part of the manufacturing operation means the information is utilized more efficiently with less likelihood of error on the part of machine operators during grinding, polishing and finishing procedures.

It will be understood by those skilled in the art that variations in the design of shaped portion 28 are possible, such that codable information can be provided. The only requirement is that the shaped portion be symmetrical about the longitudinal axis.

Having described the invention in connection with certain specific embodiments thereof, it is to be understood that the description is not meant as a limitation since further modifications will now suggest themselves to those skilled in the art and it is intended to cover such modifications as fall within the scope of the appended claims.

We claim:

1. A dop for handling a gemstone comprising:

an elongate shaft having shank and gripper portions located at respective ends thereof, and a shaped portion provided therebetween on the shaft and defining a plurality of externally sensible features for providing information uniquely identifying the dop and for establishing its spatial orientation and that of the gemstone.

2. The dop of claim 1 wherein said shaped portion comprises a series of circumferential rings having different radial dimensions providing a unique dop identification code.

3. The dop of claim 2 wherein said shaped portion comprises a series of circumferential rings having different axial dimensions providing a unique dop identification code.

4. The dop of claim 3 wherein a series of stepped shoulders is formed between said circumferential rings, each shoulder defining said axial dimension, said dop identification code being provided by a combination of said axial dimensions.

5. The dop of claim 4 wherein combinations of said radial and axial height dimensions provide codes uniquely identifying the dop.

6. The dop of claim 3 wherein combinations of said radial and axial height dimensions provide codes uniquely identifying the dop.

7. The dop of claim 6 wherein said shaped portion is machined as an integral part of the dop construction.

8. The dop of claim 2 wherein said circumferential rings comprising said shaped portion may each be placed on said shaft and fastened thereon.

9. The dop of claim 8 wherein at least one of said circumferential rings has a bore hole extending therethrough and to one side of the shaft axis.

10. The dop of claim 2 wherein at least one of said circumferential rings has a bore hole extending therethrough and to one side of the shaft axis.

11. The dop of claim 10 wherein a light detector is provided near one end of said bore hold for sensing the passage of light therethrough to determine the dop orientation.

12. The dop of claim 11 wherein a predetermined amount of dop insertion in a gemstone finishing machine together with determination of the dop orientation in relation to said bore hole establishes the spatial orientation of the dop and provides a reference point for beginning a finishing procedure on the gemstone.

13. The dop of claim 12 associated with a non-contact optical system arranged to read said dop identification code using edge detection techniques.

14. The dop of claim 2 wherein a non-contact optical system is provided for reading said dop identification code using edge detection techniques.

15. The dop of claim 14 wherein a mechanical sensing means is employed to read said dop identification code by contact with said circumferential rings.

16. The dop of claim 2 wherein a mechanical sensing means is employed to read said dop identification code by contact with said circumferential rings.

17. The dop of claim 16 wherein said mechanical sensing means is provided by a series of feeler gauges.

18. The dop of claim 17 wherein said shaft further defines a portion of smaller diameter adjacent said gripper portion adapted to permit passage of light therearound.

19. The dop of claim 1 wherein said shaped portion is made as an integral part of the dop constructions.

20. The dop of claim 19 wherein said circumferential rings comprising said shaped portion may each be placed on said shaft and fastened thereon.

21. The dop of claim 1 wherein said shaft further defines a portion of smaller diameter adjacent said gripper portion for passage of light therearound.

22. The dop of claim 1 wherein said shaped portion comprises a series of circumferential rings having different axial dimensions providing a unique dop identification code.

23. A method of identifying a gemstone comprising the steps of:

mounting the gemstone on a dop including an elongate shaft having shank and gripper portions located at respective ends thereof, and a shaped portion provided therebetween on the shaft and defining a plurality of externally sensible features in a coded combination; and sensing said externally sensible features for uniquely identifying the dop in accordance with said coded combination.

24. The method of claim 23 wherein said sensing step includes detecting a reference point to one side of said shaft to precisely determine the dop orientation.

25. The method of claim 24 further comprising a manufacturing step performed in relation to said reference point.

26. The method of claim 25 further comprising the step of uniquely identifying a working procedure associated with the gemstone based on the dop identification in said sensing step.

27. The method of claim 23 further comprising the step of uniquely identifying a working procedure associated with the gemstone based on the dop identification in said sensing step.

28. The method of claim 27 wherein said sensing step includes detecting at least one radial dimension defined by said shaped portion.

29. The method of claim 23 wherein said sensing step includes detecting at least one radial dimension defined by said shaped portion.

30. The method of claim 29 wherein said sensing step includes detecting a plurality of radial dimensions defined by said shaped portion, the combination of said detected radial dimensions providing a code identifying said dop.

31. The method of claim 23 wherein said sensing step includes detecting a plurality of radial dimensions about said shaft defined by said shaped portion, the combination of said detected radial dimensions providing a code identifying said dop.

32. The method of claim 31 wherein said sensing step includes detecting at least one axial height dimension as defined by said shaped portion.

33. The method of claim 23 wherein said sensing step includes detecting at least one axial height dimension defined by said shaped portion.

34. The method of claim 33 wherein said sensing step includes detecting a plurality of axial height dimensions defined by said shaped portion, the combination of said axial height dimensions providing a code identifying said dop.

35. The method of claim 23 wherein said sensing step includes detecting a plurality of axial height dimensions defined by said shaped portion, the combination of said axial height dimensions providing a code identifying said dop.

36. The method of claim 35 wherein said sensing step includes detecting a combination of said axial height dimensions and said radial dimensions which provides a code for identifying said dop.

37. The method of claim 36 wherein said sensing step is performed by a non-contact optical system using edge detection techniques.

38. The method of claim 23 wherein said sensing step is performed by a non-contact optical system using edge detection techniques.

39. The method of claim 38 wherein said sensing step is performed by a mechanical sensing means contacting said shaped portion.

40. The method of claim 23 wherein said sensing step is performed by a mechanical sensing means contacting said shaped portion.

* * * * *